US011519227B2

(12) United States Patent
Peters

(10) Patent No.: US 11,519,227 B2
(45) Date of Patent: Dec. 6, 2022

(54) VIBRATION ISOLATING COUPLER FOR REDUCING HIGH FREQUENCY TORSIONAL VIBRATIONS IN A DRILL STRING

(71) Applicant: Volker Peters, Wienhausen (DE)

(72) Inventor: Volker Peters, Wienhausen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/017,895

(22) Filed: Sep. 11, 2020

(65) Prior Publication Data

US 2021/0079737 A1 Mar. 18, 2021

Related U.S. Application Data

(60) Provisional application No. 62/899,354, filed on Sep. 12, 2019, provisional application No. 62/899,291, filed on Sep. 12, 2019, provisional application No. 62/899,322, filed on Sep. 12, 2019, provisional application No. 62/899,331, filed on Sep. 12, 2019.

(51) Int. Cl.
*E21B 17/07* (2006.01)
*E21B 17/042* (2006.01)

(52) U.S. Cl.
CPC ..... *E21B 17/07* (2013.01); *E21B 17/042* (2013.01)

(58) Field of Classification Search
CPC ..... E21B 17/07; E21B 17/042; E21B 17/076
See application file for complete search history.

(56) References Cited

U.S. PATENT DOCUMENTS 2,585,382 A 2/1952 Guernsey
2,834,225 A 5/1958 Carter et al.
2,953,351 A 9/1960 Bodine et al.
(Continued)

FOREIGN PATENT DOCUMENTS

CN 103939092 A 7/2014
DE 102017004126 A1 10/2018
(Continued)

OTHER PUBLICATIONS

Aiken ID, Nims DK, Whittaker AS, Kelly JM. "Testing of Passive Energy Dissipation Systems". Earthquake Spectra. 1993;9(3):335-370.

(Continued)

*Primary Examiner* — Abby J Flynn
*Assistant Examiner* — Yanick A Akaragwe
(74) *Attorney, Agent, or Firm* — Cantor Colburn LLP

(57) ABSTRACT

A vibration isolating coupler for isolating torsional vibration in a drill string includes a first coupler portion including a first annular wall having an external surface and an internal surface defining a first central bore portion and a second coupler portion disposed within the first central bore portion. The second coupler portion includes a second annular wall having an external surface section and an internal surface section defining a second central bore portion, and a plurality of connecting elements extending from the internal surface of the first annular wall through the second annular wall across the second central bore portion and connecting with the internal surface of the second annular wall.

30 Claims, 5 Drawing Sheets

(56) References Cited

U.S. PATENT DOCUMENTS

| | | | |
|---|---|---|---|
| 3,099,918 | A | 8/1963 | Garrett |
| 3,121,347 | A | 2/1964 | Rumsey |
| 3,323,326 | A | 6/1967 | Vertson |
| 3,552,230 | A | 1/1971 | McLean |
| 3,610,347 | A | 10/1971 | Diamantides et al. |
| 3,848,931 | A | 11/1974 | Swisher |
| 4,428,443 | A | 1/1984 | Oliphant |
| 4,502,552 | A | 3/1985 | Martini |
| 4,522,271 | A | 6/1985 | Bodine et al. |
| 4,593,889 | A | 6/1986 | Odobasic |
| 4,619,334 | A | 10/1986 | Gustafsson |
| 5,372,548 | A | 12/1994 | Wohlfeld |
| 5,743,362 | A | 4/1998 | Clinard et al. |
| 6,098,726 | A | 8/2000 | Taylor et al. |
| 6,158,529 | A | 12/2000 | Dorel |
| 6,327,539 | B1 | 12/2001 | Keultjes et al. |
| 6,758,921 | B1 | 7/2004 | Streubel et al. |
| 6,808,455 | B1 | 10/2004 | Solorenko et al. |
| 7,036,612 | B1 | 5/2006 | Raymond et al. |
| 7,219,752 | B2 | 5/2007 | Wassell et al. |
| 7,779,933 | B2 | 8/2010 | Sihler et al. |
| 8,214,188 | B2 | 7/2012 | Bailey et al. |
| 8,453,764 | B2 | 6/2013 | Turner et al. |
| 8,798,978 | B2 | 8/2014 | Ertas et al. |
| 8,950,512 | B2 | 2/2015 | Nessjoen et al. |
| 8,977,523 | B2 | 3/2015 | Ertas et al. |
| 9,004,195 | B2 | 4/2015 | Regener et al. |
| 9,109,410 | B2 | 8/2015 | Swietlik et al. |
| 9,249,632 | B2 | 2/2016 | Lakkashetti et al. |
| 9,382,761 | B2 | 7/2016 | Huang et al. |
| 9,458,679 | B2 | 10/2016 | Turner et al. |
| 9,476,261 | B2 | 10/2016 | Venugopal et al. |
| 9,581,008 | B2 | 2/2017 | Kyllingstad |
| 9,677,347 | B2 | 6/2017 | Ash et al. |
| 9,976,405 | B2 | 5/2018 | Hohl et al. |
| 10,782,197 | B2 | 9/2020 | Wu et al. |
| 2003/0062170 | A1 | 4/2003 | Slack |
| 2004/0028490 | A1 | 2/2004 | Bergholt et al. |
| 2004/0238219 | A1 | 12/2004 | Nichols et al. |
| 2005/0145417 | A1 | 7/2005 | Radford et al. |
| 2006/0124354 | A1 | 6/2006 | Witte |
| 2006/0278442 | A1 | 12/2006 | Kristensen |
| 2007/0289778 | A1 | 12/2007 | Watkins |
| 2008/0060849 | A1 | 3/2008 | Entchev et al. |
| 2009/0044977 | A1 | 2/2009 | Johnson et al. |
| 2010/0025118 | A1* | 2/2010 | Hampson ..... F16D 3/12 175/321 |
| 2010/0139977 | A1 | 6/2010 | Watkins et al. |
| 2011/0077924 | A1 | 5/2011 | Ertas et al. |
| 2011/0120772 | A1 | 5/2011 | McLoughlin et al. |
| 2011/0198126 | A1 | 8/2011 | Swietlik et al. |
| 2011/0245980 | A1 | 10/2011 | Nessjoen et al. |
| 2012/0130693 | A1 | 5/2012 | Ertas et al. |
| 2012/0228028 | A1 | 9/2012 | Turner et al. |
| 2013/0092439 | A1 | 4/2013 | Mauldin et al. |
| 2014/0151122 | A1 | 6/2014 | Venugopal et al. |
| 2014/0166309 | A1* | 6/2014 | Benedict ..... F16L 15/001 166/380 |
| 2014/0284105 | A1 | 9/2014 | Veltman |
| 2014/0305660 | A1 | 10/2014 | Ash et al. |
| 2014/0318865 | A1 | 10/2014 | Doris |
| 2014/0323231 | A1 | 10/2014 | Perry |
| 2015/0050083 | A1 | 2/2015 | Funderud et al. |
| 2015/0053484 | A1 | 2/2015 | Meister et al. |
| 2015/0083493 | A1 | 3/2015 | Wassell |
| 2015/0122547 | A1 | 5/2015 | Hohl et al. |
| 2015/0259989 | A1 | 9/2015 | Gajji et al. |
| 2016/0002985 | A1* | 1/2016 | Baudoin ..... E21B 43/1195 175/56 |
| 2016/0138382 | A1 | 5/2016 | Badkoubeh et al. |
| 2016/0281488 | A1 | 9/2016 | Dwars et al. |
| 2016/0305197 | A1 | 10/2016 | Gajji et al. |
| 2016/0356089 | A1 | 12/2016 | Nanayakkara et al. |
| 2017/0030149 | A1 | 2/2017 | Kadam et al. |
| 2017/0089149 | A1 | 3/2017 | Yao et al. |
| 2017/0198840 | A1* | 7/2017 | Gabdullin ..... E21B 17/046 |
| 2017/0328142 | A1 | 11/2017 | Pratt et al. |
| 2017/0343046 | A1 | 11/2017 | Park et al. |
| 2018/0100357 | A1* | 4/2018 | Christopher ..... E21B 47/017 |
| 2018/0252054 | A1 | 9/2018 | Stokes |
| 2018/0371889 | A1 | 12/2018 | Hohl et al. |
| 2019/0284881 | A1 | 9/2019 | Hohl et al. |
| 2019/0284882 | A1 | 9/2019 | Peters |
| 2020/0018124 | A1 | 1/2020 | Hohl |
| 2020/0018377 | A1 | 1/2020 | Hohl et al. |
| 2021/0010332 | A1 | 1/2021 | Benedict et al. |
| 2021/0079736 | A1 | 3/2021 | Reckmann et al. |
| 2021/0079738 | A1 | 3/2021 | Peters et al. |
| 2021/0079976 | A1 | 3/2021 | Hohl et al. |
| 2021/0207469 | A1 | 7/2021 | Nash et al. |
| 2022/0112775 | A1 | 4/2022 | Peters et al. |

FOREIGN PATENT DOCUMENTS

| | | | |
|---|---|---|---|
| WO | 2005047640 | A2 | 5/2005 |
| WO | 20160007689 | A1 | 1/2016 |

OTHER PUBLICATIONS

Damptech, "21-001 B comparison between different dampers: Rotational friction damper compared to other dampers", 2017, 4 pages.

Fitzgerald, T.F., Anagnos, T., Goodson, M. and Zsutty, T., (1989). "Slotted bolted connections in aseismic design of concentrically braced connections." Earthquake Spectra, 5(2), 383-391.

Grigorian, C. E., Popov, E. P., "Energy Dissipation with Slotted Bolted Connections", Earthquake Engineering Research Center, College of Engineering, University of California at Berkley, Feb. 1994, 255 pages.

Grigorian, C.E. and Popov, E.P. (1993), "Slotted bolted connections for energy dissipation." Proc. ATC-17-1 Seminar on Seismic Isolation, Passive Energy Dissipation, and Active Control, San Francisco, March, 14 pages.

Hohl, et al.; "Prediction and Mitigation of Torsional Vibrations in Drilling Systems"; IADC/SPE-178874-MS; Mar. 2016, IADC/SPE Drilling Conference and Exhibition; 15 pages.

Hohl, et al; "Derivation and Experimental Validation of an Analytical Criterion for the Identification of Self-Excited Modes in Drilling System"; Journal of Sound and Vibration 342; 2015; 13 pages.

International Search Report and Written Opinion for International Application No. PCT/US2019/022198; International Filing Date Mar. 14, 2019; Report dated Jul. 2, 2019 (pp. 1-10).

International Search Report and Written Opinion for International Application No. PCT/US2020/050419; International Filing Date Sep. 11, 2020; Report dated Dec. 15, 2020 (pp. 1-10).

International Search Report and Written Opinion for International Application No. PCT/US2020/050425; International Filing Date Sep. 11, 2020; Report dated Dec. 21, 2020 (pp. 1-10).

International Search Report and Written Opinion for International Application No. PCT/US2020/050430; International Filing Date Sep. 11, 2020; Report dated Dec. 18, 2020 (pp. 1-8).

International Search Report and Written Opinion for International Application No. PCT/US2020/050475; International Filing Date Sep. 11, 2020; Report dated Dec. 23, 2020 (pp. 1-8).

International Search Report and Written Opinion for International Application No. PCT/US2019/022196; International Filing Date Mar. 14, 2019; Report dated Jul. 2, 2019 (pp. 1-11).

Oueslati, et al.; "New Insights Into Drilling Dynamics Through High-Frequency Vibration Measurement and Modeling"; SPE 166212; 2013; Society of Petroleum Engineers; 15 pages.

International Search Report and Written Opinion for International Application No. PCT/US2020/049019, International Filing Date Sep. 2, 2020; Report dated Dec. 8, 2020; pp. 1-12.

* cited by examiner

VIBRATION ISOLATING COUPLER FOR REDUCING HIGH FREQUENCY TORSIONAL VIBRATIONS IN A DRILL STRING

CROSS REFERENCE TO RELATED APPLICATION

This application claims the benefit of U.S. Provisional Application Ser. No. 62/899,354, filed Sep. 12, 2019, U.S. Provisional Application Ser. No. 62/899,291, filed Sep. 12, 2019, U.S. Provisional Application Ser. No. 62/899,331, filed Sep. 12, 2019, and U.S. Provisional Application Ser. No. 62/899,332, filed Sep. 12, 2019, the entire disclosures of which are incorporated herein by reference.

BACKGROUND

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation (e.g., a compartment) located below the earth's surface. Different types of tools and instruments may be disposed in the boreholes to perform various tasks and measurements.

In operation, the downhole components may be subject to vibrations that can impact operational efficiencies. For example, severe vibrations in drill strings and bottom hole assemblies can be caused by cutting forces at the bit or mass imbalances in downhole tools such as mud motors. Vibrations may take the form of stick/slip vibrations and high frequency torsional oscillations (HFTO). HFTO vibrations typically occur at frequencies above 50 Hz and may be localized to a small portion of the drill string. Typically, HFTO have high amplitudes at the bit. Impacts from such vibrations can include, but are not limited to, reduced rate of penetration, reduced quality of measurements, and excess fatigue and wear on downhole components, tools, and/or devices.

SUMMARY

Disclosed is a vibration isolating coupler for isolating torsional vibration in a drill string including a first coupler portion including a first annular wall having an external surface and an internal surface defining a first central bore portion and a second coupler portion disposed within the first central bore portion. The second coupler portion includes a second annular wall having an external surface section and an internal surface section defining a second central bore portion, and a plurality of connecting elements extending from the internal surface of the first annular wall through the second annular wall across the second central bore portion and connecting with the internal surface of the second annular wall.

Also disclosed is a method of isolating torsional vibrations from one portion of a drill string connected to another portion of the drill string through a vibration isolating coupler having a first coupler portion connected to a second coupler portion through a plurality of connecting elements. The method includes introducing the torsional vibrations into the first coupler portion, transferring the torsional vibration into the plurality of connector elements extending from an internal surface section of the second coupler portion, through an annular wall of the second coupler portion to an internal surface of the first coupler portion, and isolating the torsional vibrations passing from the first coupler portion to the second coupler portion by elastic bending of the plurality of connecting elements.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
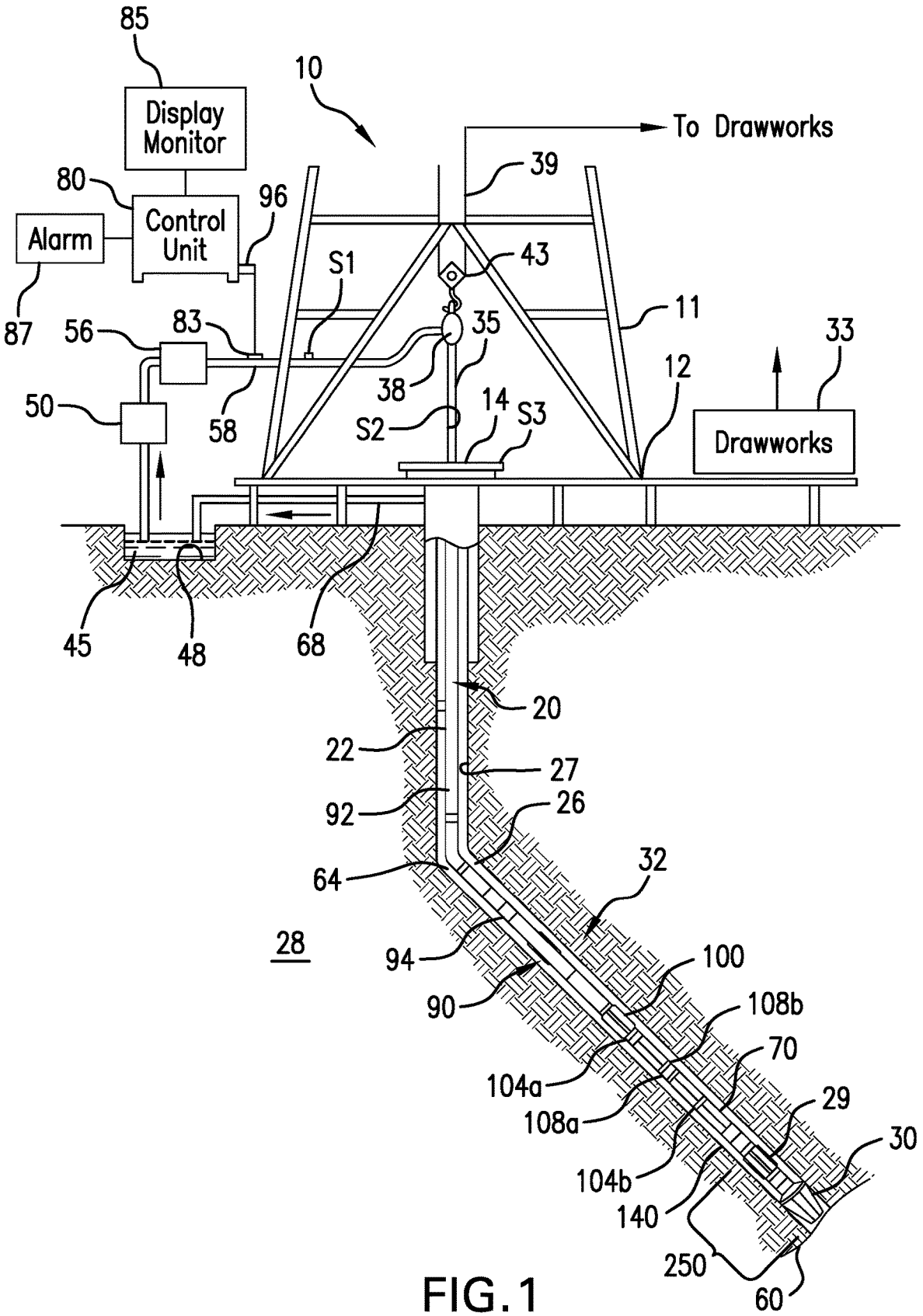
FIG. 1 depicts a resource exploration and recovery system including a vibration isolating coupler, in accordance with an aspect of an exemplary embodiment.

FIG. 1 shows a schematic diagram of a resource exploration and recovery system for performing downhole operations. As shown, the resource exploration and recovery system takes the form of a drilling system 10. Drilling system 10 includes a conventional derrick 11 erected on a floor 12 that supports a rotary table 14 that is rotated by a prime mover, such as an electric motor (not shown), at a desired rotational speed. Drilling system 10 also includes a downhole assembly having a drill string 20 that extends through rotary table 14 and includes a drilling tubular 22, such as a drill pipe, that extends into a borehole 26 having an annular wall 27 extending into a formation 28. Drill string 20 may be a directional drill string and include deflection device, a drilling motor, and/or a steering unit such as shown at 29. A disintegrating tool 30, such as a drill bit, is attached to the end of drill string 20. Disintegrating tool 30 forms part of a bottom hole assembly (BHA) 32. Disintegrating tool 30 is operated to disintegrate the geological formation when it is rotated thereby forming borehole 26. Drill string 20 is coupled to surface equipment such as systems for lifting, rotating, and/or pushing, including, but not limited to, a drawworks 33 via a kelly joint 35, swivel 38 and line 39 through a pulley 43. In some embodiments, the surface equipment may include a top drive (not shown). During the drilling operations, the drawworks 33 is operated to control the weight on bit, which affects the rate of penetration. The operation of the drawworks 33 is well known in the art and is thus not described in detail herein.

During drilling operations a suitable drilling fluid 45 (also referred to as the "mud") from a source or mud pit 48 is circulated under pressure through an inner bore of the drill string 20 (including an inner bore of the BHA) by a mud pump 50. Drilling fluid 41 passes into drill string 20 via a desurger 56, fluid line 58 and the kelly joint 35. Drilling fluid 41 is discharged at a bottom 60 of borehole 26 through an opening in disintegrating tool 30. Drilling fluid 41 circulates uphole through an annular space 64 between the drill string 20 and annular wall 27 of borehole 26 (borehole wall) and returns to mud pit 48 via a return line 68. A sensor S1 in the fluid line 58 provides information about the fluid flow rate. A surface torque sensor S2 and a sensor S3 associated with drill string 20 respectively provide information about the torque and the rotational speed of drilling tubular 22. Additionally, one or more sensors (not shown) associated with line 39 are used to provide hook load data of drill string 20 as well as other desired parameters relating to the drilling of borehole 26. Drilling system 10 may further include one or more downhole sensors 70 located on the drill string 20 and/or the BHA 32.

In some applications the disintegrating tool 30 is rotated by rotating drilling tubular 22. However, in other applications, a drilling motor (not shown) such as, a mud motor may form part of BHA 32 and may be operated to rotate disintegrating tool 30 and/or to superimpose or supplement the rotation of the drill string 20. In either case, the rate of penetration (ROP) of the disintegrating tool 30 into the earth formation 28 for a given formation and a given drilling assembly largely depends upon the weight on bit and drill bit rotational speed.

A surface control unit 80 receives signals from downhole sensors 70 and devices via a transducer 83, such as a pressure transducer, placed in the fluid line 58 as well as from sensors S1, S2, S3, hook load sensors, RPM sensors, torque sensors, and any other sensors. Surface control unit 80 processes such signals according to programmed instructions. Surface control unit 80 may display desired drilling parameters and other information on a display/monitor 85 for use by an operator at the rig site to control drilling operations. Surface control unit 80 contains a computer, memory for storing data, computer programs, models and algorithms accessible to a processor in the computer, a recorder, such as tape unit, memory unit, etc. for recording data and other peripherals. Surface control unit 80 may also include simulation models for use by the computer to processes data according to programmed instructions. Surface control unit 80 may respond to user commands entered through a suitable device, such as a keyboard. Surface control unit 80 is adapted to activate alarms 87 when certain unsafe or undesirable operating conditions occur.

BHA 32 also contains other sensors and devices or tools for providing a variety of measurements relating to formation 28 and for drilling borehole 26 along a desired path. Such devices may include a device for measuring formation resistivity near and/or in front of disintegrating tool 30, a gamma ray device for measuring the formation gamma ray intensity and devices for determining the inclination, azimuth and position of drilling tubular 22. Other devices, such as logging-while-drilling (LWD) devices indicated generally at 90 such as devices for measuring formation porosity, permeability, density, rock properties, fluid properties, etc. may be placed at suitable locations in BHA 32 for providing information useful for evaluating formation 28 borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 92, which in turn transmits the received data uphole to the surface control unit 80. Downhole telemetry system 92 also receives signals and data from the surface control unit 80 and transmits such received signals and data to appropriate downhole devices. In one aspect, a mud pulse telemetry system may be used to communicate data between downhole sensors, indicated generally at 94 arranged on drill string 20 and devices and the surface equipment during drilling operations. Transducer 83 placed in the fluid line 58 (e.g., mud supply line) detects the mud pulses responsive to the data transmitted by the downhole telemetry system 92. Transducer 83 generates electrical signals in response to the mud pressure variations and transmits such signals via a conductor 96 to surface control unit 80.

In other aspects, any other suitable telemetry system may be used for two-way data communication (e.g., downlink and uplink) between the surface and the BHA 32, including but not limited to, an acoustic telemetry system, an electromagnetic telemetry system, an optical telemetry system, a wired pipe telemetry system which may utilize wireless couplers or repeaters in the drill string or the borehole. The wired pipe telemetry system may be made up by joining drill pipe sections, wherein each pipe section includes a data communication link, such as a wire, that runs along the pipe. The data connection between the pipe sections may be made by any suitable method, including but not limited to, hard electrical or optical connections, induction, capacitive, resonant coupling, such as electromagnetic resonant coupling, or direct coupling methods. In case a coiled-tubing is used as the drilling tubular 22, the data communication link may be run along a side of the coiled-tubing.

Drilling system 10 relates to those drilling systems that utilize a drill pipe to convey the BHA 32 into borehole 26, wherein the weight on bit is controlled from the surface, typically by controlling the operation of drawworks 33. However, a large number of the current drilling systems, especially for drilling highly deviated and horizontal boreholes, utilize coiled-tubing for conveying the drilling assembly downhole. In such application a thruster (not separately labeled) may be deployed in drill string 20 to provide the desired force on disintegrating tool 30. Also, when coiled-tubing is utilized, the tubing is not rotated by a rotary table but instead it is injected into the borehole by a suitable injector while a downhole motor, such as a drilling motor (not shown), rotates the disintegrating tool 30. For offshore drilling, an offshore rig or a vessel may be used to support the drilling equipment, including the drill string.

Still referring to FIG. 1, a resistivity tool 100 may be provided that includes, for example, a plurality of antennas including, for example, transmitters 104*a* or 104*b* and/or receivers 108*a* or 108*b*. Resistivity can be one formation property that is of interest in making drilling decisions. Those of skill in the art will appreciate that other formation property tools can be employed with or in place of the resistivity tool 100.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, completion, wireline, wired pipe, liner drilling, reaming, coiled tubing, re-entry and/or other configurations can be used as known in the art. Further, production configurations can be employed for extracting and/or injecting materials from/into earth formations. Thus, the present disclosure is not to be limited to drilling operations but can be employed for any appropriate or desired downhole operation (s).

Severe vibrations in drill strings and bottom hole assemblies during drilling operations can be caused by cutting forces at the bit or mass imbalances in downhole tools such as drilling motors. Such vibrations can result in reduced rate of penetration, reduced quality of the borehole, reduced quality of measurements made by tools of the bottom hole assembly, and can result in wear, fatigue, and/or failure of downhole components. As appreciated by those of skill in the art, different vibrations exist, such as lateral vibrations, axial vibrations, and torsional vibrations. For example, stick/slip of the whole drilling system and high-frequency torsional oscillations ("HFTO") are both types of torsional vibrations. The terms "vibration," "oscillation," as well as "fluctuation," are used with the same broad meaning of repeated and/or periodic movements or periodic deviations of a mean value, such as a mean position, a mean velocity, and a mean acceleration. In particular, these terms are not meant to be limited to harmonic deviations, but may include all kinds of deviations, such as, but not limited to periodic, harmonic, and statistical deviations.

Torsional vibrations may be excited by self-excitation mechanisms that occur due to the interaction of the drill bit or any other cutting structure such as a reamer bit and the formation. The main differentiator between stick/slip and HFTO is the frequency and typical mode shapes: For example, critical HFTO have a frequency that is typically above 50 Hz compared to stick/slip torsional vibrations that typically have frequencies below 1 Hz. Typically, critical HFTO may be in a range between of 50 Hz and 500 Hz. A criterion to identify critical HFTO modes is described in Andreas Hohl et al., Journal of Sound and Vibration 342 (2015), 290-302. Critical HFTO modes, critical frequencies and critical mode shapes may also be referred to as undesirable HFTO modes, undesirable frequencies and undesirable mode shapes. Moreover, the excited mode shape of stick/slip is typically a first mode shape of the whole drilling system whereas the mode shape of HFTO can be of higher order and are commonly localized to smaller portions of the drilling system with comparably high amplitudes at the point of excitation that may be the bit or any other cutting structure (such as a reamer bit), or any contact between the drilling system and the formation (e.g., by a stabilizer).

Due to the high frequency of the vibrations, HFTO correspond to high acceleration and torque values along the BHA or at only a portion of the BHA. Those skilled in the art will appreciate that for torsional movements, one of acceleration, force, and torque is always accompanied by the other two of acceleration, force, and torque. In that sense, acceleration, force, and torque are equivalent in the sense that none of these can occur without the other two. The loads of high frequency vibrations can have negative impacts on efficiency, reliability, and/or durability of electronic and mechanical parts of the BHA. Embodiments provided herein are directed to providing a vibration isolating coupler 140 to mitigate HFTO. Vibration isolating coupler 140 is a modular tool that may be installed at various positions above, below, or within BHA 32. For example, vibration isolating coupler 140 can be installed above the drill bit. In a directional drill string (directional BHA). In a directional drill string (directional BHA) steering unit 29 may be located above the drill bit. Steering unit 29 is located close to the drill bit in order to deflect the drilling direction of the drill bit. In a BHA with a steering unit, it is desirable to position vibration isolating coupler 140 above the steering unit. Above vibration isolating coupler 140 there may be located one or more formation evaluation tools.

Disintegrating tool 30 represents a point of excitation for HFTO. Without the vibration isolating coupler placed in the BHA, disintegrating tool 30 excite HFTO at undesirable frequencies along the whole BHA. Vibration isolating coupler 140 isolates the portion of the BHA above the vibration isolating coupler 140 from propagation of HFTO excited in the portion of the BHA below the vibration isolating BHA. Vibration isolating coupler 140 restricts the HFTO excited by the cutting forces at the drill bit 30 to the BHA below vibration isolating coupler 140. Due to the design of vibration isolation coupler 140, the torsional dynamics of the BHA are modified to allow undesirable HFTO mode shapes to have significant amplitude only in the portion of the BHA below vibration isolating coupler 140.

Vibration isolating coupler 140 in the BHA allows the portion of the BHA below vibration isolating coupler 140 to oscillate (HFTO) by isolating the oscillation from the portion of the BHA above vibration isolating coupler. Also, vibration isolating coupler 140 changes the number of excited undesirable HFTO modes. In a BHA with vibration isolating coupler 140, a smaller number of undesirable HFTO modes are excited. Vibration isolating coupler 140 acts as a mechanical low-pass filter for HFTO and comprises an isolating frequency (natural frequency or first resonance frequency).

The isolating effects results from a significantly smaller isolating frequency of the vibration isolating coupler compared to the HFTO frequencies excited at the drill bit or at any other cutting structure in the BHA. The smaller isolating frequency can be achieved by using a vibration isolating coupler with a sufficiently small torsional stiffness. The small torsional stiffness of vibration isolating coupler isolates the mass located below from the mass located above in the torsional degree of freedom for frequencies above the isolating frequency. HFTO modes excited at the bit with frequencies above the isolating frequency are isolated from the portion of the BHA above vibration isolating coupler 140. The term small torsional stiffness refers to a ratio between bending stiffness and torsional stiffness (bending stiffness/torsional stiffness (BST/TST)) bigger than 10, bigger than 15, bigger then 20, bigger than 30, bigger than 40, or bigger than 50.

In an embodiment, a desirable isolating frequency for vibration isolating coupler in a downhole assembly is between 10 Hz and 200 Hz. In another embodiment, the isolating frequency may be between 10 Hz and 100 Hz. In yet another embodiment, the isolating frequency may be between 20 Hz and 50 Hz. In still yet another embodiment, an isolating frequency of 30 Hz reduces isolates undesirable HFTO modes e.g., HFTO modes in a range between of 50 Hz and 500 Hz.

The isolating frequency of the vibration isolating coupler depends on the torsional spring constant (proportional to torsional stiffness) of the vibration isolating coupler and the oscillating mass below the vibration isolating coupler. In an embodiment, locating vibration isolating coupler 140 above the steering unit 29 and disintegrating tool 30 provides a sufficient high oscillating mass (mass of inertia) to achieve an isolating frequency of around 30 Hz. Smaller masses, e.g. only the drill bit, lead to isolating frequencies higher than 30 Hz, e.g. 100 Hz to 200 Hz. BHA components located close to the disintegrating tool 30 are designed to withstand high level of vibrations (axial, lateral and torsional).

An isolating frequency of 30 Hz limits the undesirable HFTO modes and the associated torque loads and angular acceleration loads acting on steering unit 29 and the drill bit 30 to only a few critical HFTO modes. As shown in FIG. 2, there are also other modes at or near the isolating frequency of 30 Hz that have a higher likelihood of occurrence but are not considered undesirable. A higher isolating frequency would lead to more undesirable HFTO modes being excited in the portion of the BHA below vibration isolating coupler 140, potentially resulting in damages in the steering unit 29 or disintegrating tool 30.

In an embodiment the lower part of the BHA, e.g., that portion of the BHA below vibration isolating coupler 140, is decoupled (isolated) in terms of HFTO from the upper part of the BHA, e.g., that portion of the BHA above vibration isolating coupler 140. In alternative embodiments undesirable HFTO modes may be excited in a portion of the BHA above vibration isolating coupler 140, e.g. by a reamer. In such a case, vibration isolating coupler 140 isolates the portion of the BHA below vibration isolating coupler 140 from undesirable HFTO modes. In a BHA with a vibration isolating coupler as described herein, the undesirable HFTO mode shape amplitudes above vibration isolating coupler 140 (portion of the BHA with no HFTO excitation) are comparatively low as compared to the HFTO mode shape amplitudes below the vibration isolating coupler 140 (portion of the BHA with HFTO excitation).

Figure 2A:
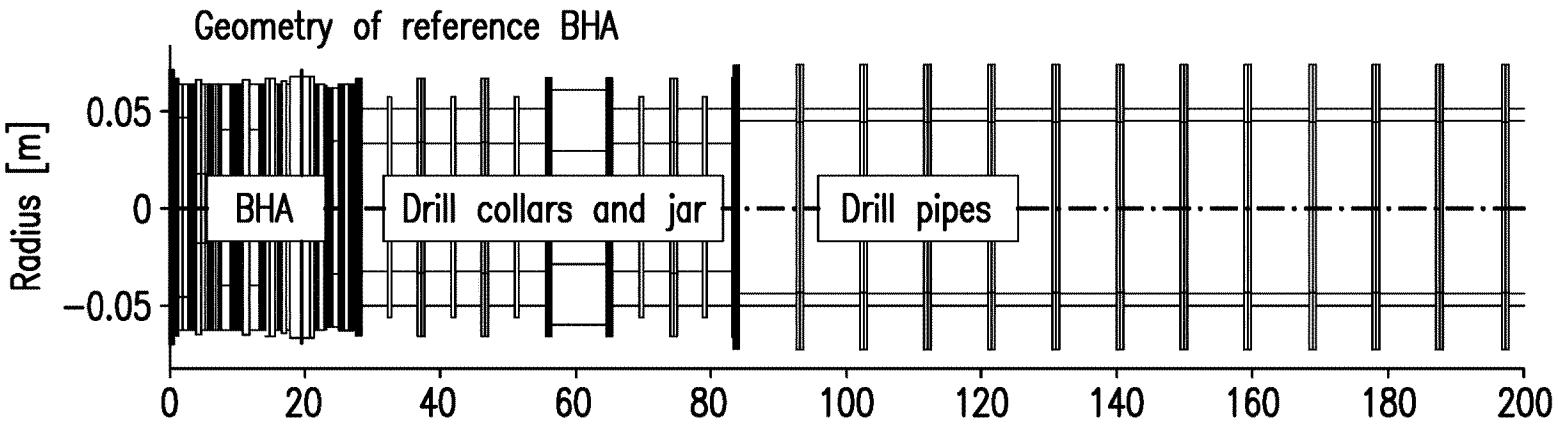
FIG. 2A depicts a bottom hole assembly (BHA) geometry without a vibration isolating coupler.
Figure 2B:
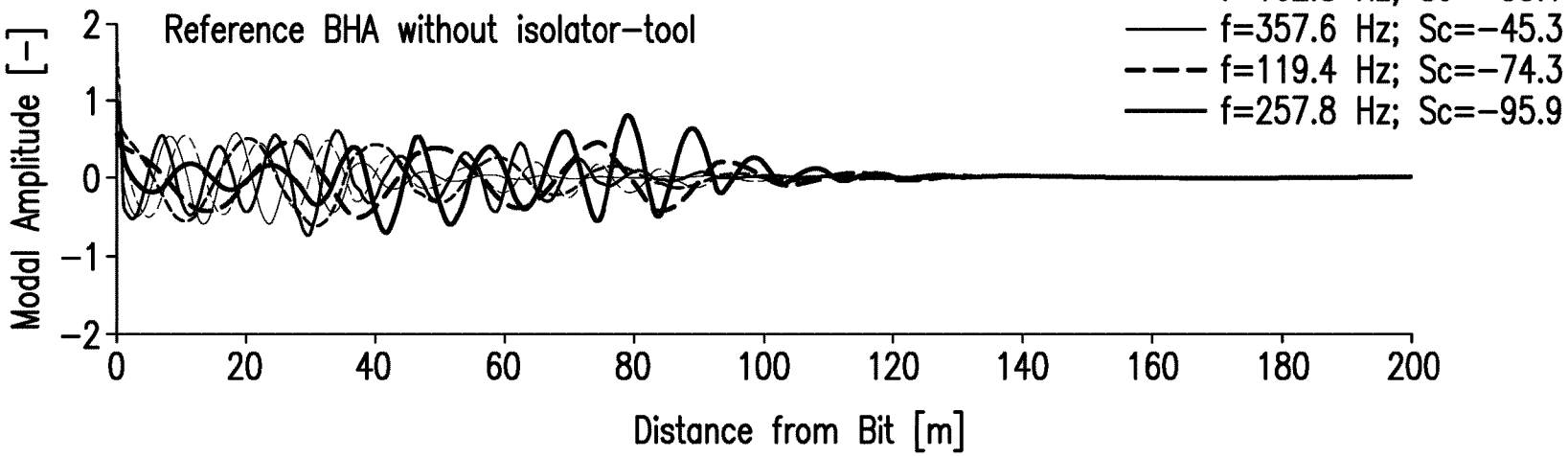
FIG. 2B depicts high frequency torsional oscillation (HFTO) modes without a vibration isolating coupler.

FIGS. 2A and 2B show a geometry of a reference BHA (4.75" tool size) in a drill string without a vibration isolating coupler showing six exemplary undesirable HFTO mode shapes with respective frequencies (f) between 119.4 Hz and 357.6 Hz. The Parameter $S_c$ is an indicator for the likelihood of occurrence of a HFTO mode shape. The HFTO mode shape amplitudes indicate where torsional vibration energy is appearing in the BHA section of the drill string.

Figure 3A:
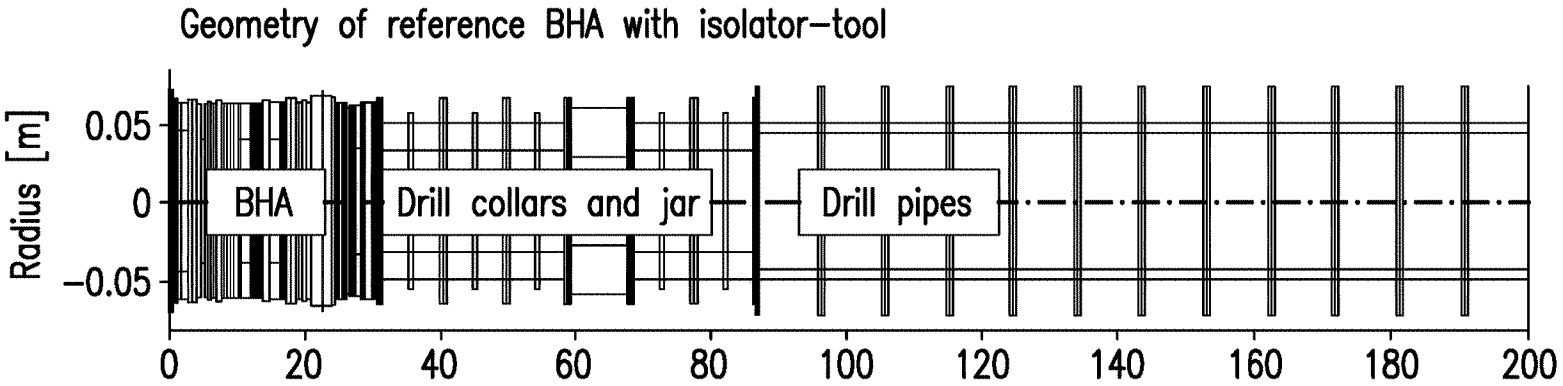
FIG. 3A depicts a BHA geometry with a vibration isolating coupler, in accordance with an exemplary aspect.
Figure 3B:
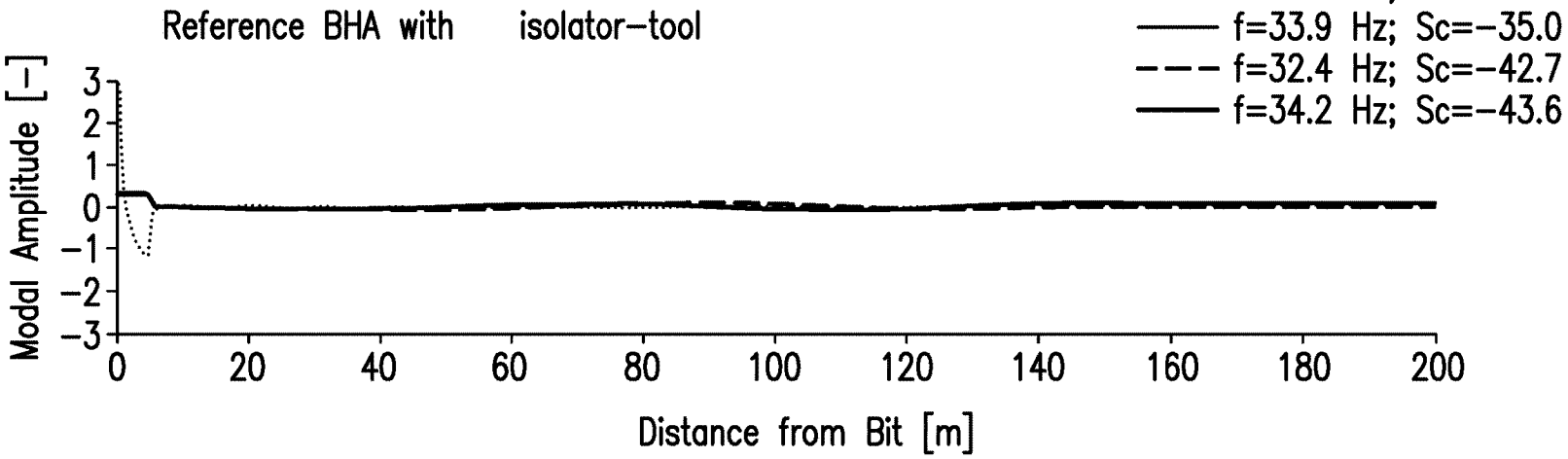
FIG. 3B depicts HFTO modes with a vibration isolating coupler, in accordance with an exemplary embodiment.

FIGS. 3A and 3B show the geometry of the reference BHA in the drill string with a vibration isolating coupler in accordance with an exemplary embodiment, placed above disintegrating tool 30 and steering unit 29. The incorporation of vibration isolating coupler 140 leads to a reduced number of undesirable HFTO modes in the frequency range of 50 Hz to 500 Hz. There are also other modes at or near the isolating frequency of vibration isolating coupler 140 (30 Hz) that have a high likelihood of occurrence. However, these HFTO modes with small frequency (around 30 Hz) can be considered less undesirable due to their small frequencies and small amplitudes compared to the amplitudes appearing along the BHA in the reference BHA without a vibration isolating coupler (FIG. 2B).

FIG. 3B shows that HFTO are concentrated at disintegrating tool 30 and steering unit 29. Above vibration isolating coupler 140 HFTO mode shape amplitudes are smaller as compared to the amplitudes of the respective mode shape amplitudes below vibration isolating coupler 140. HFTO mode shapes that existed in the upper part of the reference BHA without a vibration isolating coupler are either not excited in the BHA with the vibration isolating coupler due to the changed torsional dynamics or are appearing with a significantly smaller HFTO mode shape amplitudes. Consequently, FE tools or MWD tools including highly complex electronics (PCBAs, ceramic material including Multi-Chip Modules (MCMs)), sensors, connectors, wires, hydraulic devices, and/or mechanical devices located above the vibration isolating coupler are exposed to reduced torsional dynamic loads leading to higher quality of downhole measurement data (in particular imaging data) and increased downhole tool reliability.

It is preferred to build vibration isolating coupler 140 as short as possible to keep the FE tools close to the bit. In an embodiment, vibration isolating coupler 140 as described herein may be shorter than about 10 m. In another embodiment, vibration isolating coupler 140 may be shorter than about 5 m. In still yet another exemplary embodiment, vibration isolating coupler 140 may be shorter than about 2 m. In yet still another exemplary embodiment, vibration isolating coupler 140 may be shorter than about 1.5 m. In yet another exemplary embodiment, vibration isolating coupler 140 may be shorter than about 1.2 m. In still another exemplary embodiment, vibration isolating coupler 140 may be shorter than about 1.1 m. Further, in another exemplary embodiment, vibration isolating coupler 140 may be shorter than about 1 m. Still further, vibration isolating coupler 140 may be shorter than about 0.5 m in another example.

To achieve the desired isolating characteristic, vibration isolating coupler 140 possesses a small torsional stiffness (torsional softness) to isolate HFTO. At the same time the vibration isolating coupler has to have a high bending stiffness to facilitate the steering behavior of a directional BHA, namely the steering unit. Herein are presented different designs for a vibration isolating coupler to fulfill the required mechanical properties balancing the tradeoff between torsional softness and bending stiffness while keeping the mechanical stresses below an acceptable limit. Mechanical stresses are caused by axial loads (weight on bit (WOB)), torque applied by surface equipment (drill string rotation), dynamic bending by borehole doglegs and vibration (lateral, axial, torsional).

The vibration isolating coupler is preferably formed integrally in only one piece or may be formed from a very small number of parts. A vibration isolation coupler integrally formed without connections (such as threads, welded connections or otherwise formed connections) is less prone to tool failures. Modern manufacturing methods, such as additive manufacturing provide opportunities to create a vibration isolating coupler formed as one integrally part with a complex shape.

The bending stiffness of herein described vibration isolating coupler is not achieved by including a housing with a high bending stiffness. The vibration isolating coupler as described herein does not include bearings or other elements that include surfaces moving relative to each other. Therefore, the vibration isolating coupler does not include or utilize friction forces or friction surfaces. Friction in this context also include viscous friction (viscous force). The vibration isolating coupler as described herein does not use friction surfaces or viscous friction to dissipate rotational energy. The vibration isolating coupler does not include wear due to friction forces. It is to be mentioned that a vibration isolating coupler only isolates high frequency torsional oscillations. Rotation (non-oscillating or continuous rotation) as applied by a rotary table are transferred from the BHA above of the vibration isolating coupler to the BHA below the vibration isolating coupler. Although, the vibration isolating coupler isolates HFTO, the BHA above and below the vibration isolating coupler are rotationally coupled.

In accordance with an exemplary embodiment shown in FIGS. 4-7, vibration isolating coupler 140 includes a first connector 144 that may take the form of a box thread connector 146 and a second connector 148 that may take the form of a pin thread connector 150. A first coupler portion 154 is connected to second connector 148 and a second coupler portion 156 is coupled to first connector 144. As will be detailed herein, second coupler portion extends within and is concentric with first coupler portion 154. Further, first coupler portion 154 is operatively connected to second coupler portion 156 through a plurality of connecting elements, indicated generally at 159, as will also be detailed herein. Connecting elements 159 may be integrally formed with first coupler portion 154 and second coupler portion 156. Alternatively, connecting elements 159 may be joined to first coupler portion 154 and second coupler portion 156 through welding. A seal 160 may be arranged between first coupler portion 154 and second coupler portion 156. Seal 160 may be formed from a variety of materials, such as a rubber, an elastomer, or a metal. Further, seal 160 may allow a controlled amount of leakage between first coupler portion 154 and second coupler portion 156.

It is to be mentioned that connecting elements 159 may have different shapes as indicated in FIG. 4-7. In exemplary embodiments, connecting elements 159 may have a cross section including an I-shape, an 8-shape, a round shape (elliptical, circular), or may include a hollow profile. Connecting elements 159 may not all have the same dimensions. Further, extension in the axial direction may vary from one connecting element to another. Extension in the radial direction may vary from one connecting element to another. As used herein, the axial direction refers to a direction parallel to the longitudinal axis A (FIG. 4) of vibration isolating coupler 140 and the radial direction R (FIG. 4) herein refers to a direction perpendicular to the longitudinal axis A. A circumferential direction C (FIG. 7) refers to a tangential direction, perpendicular to the longitudinal axis A. An angle $\alpha$ (FIG. 7) refers to an angle around the longitudinal axis A.

Figure 4:
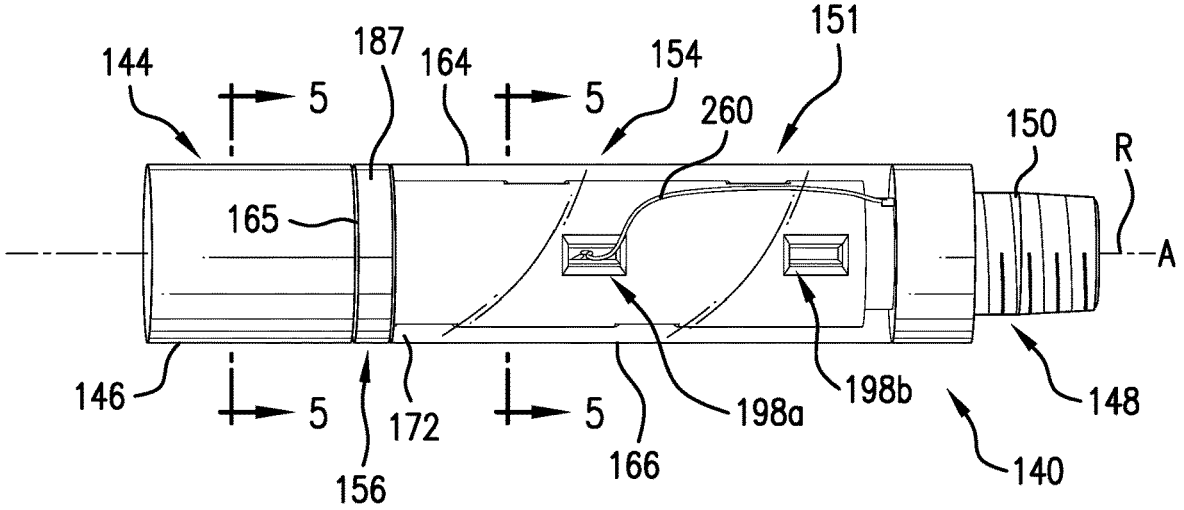
FIG. 4 depicts a plan glass view of a vibration isolating coupler, in accordance with an exemplary aspect.
Figure 5:
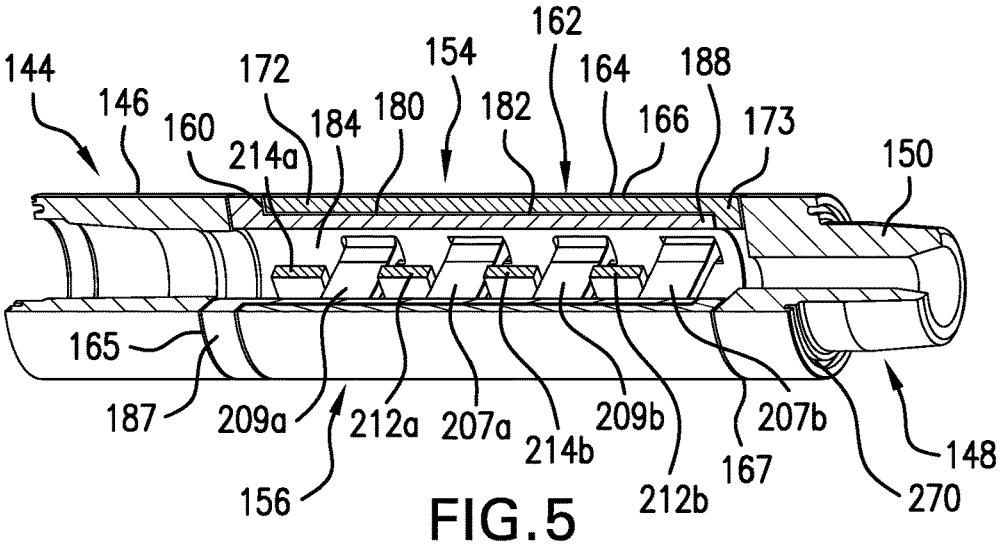
FIG. 5 depicts a cross-section view of the vibration isolating coupler of FIG. 4, in accordance with an aspect of an exemplary embodiment.

As shown in FIGS. 4 and 5 a first connector 144 may comprise a box thread connector 146 and a second connector 148 may comprise a pin thread connector 150. First connector 144 and second connector 148 may be joined by a stub weld to first coupler portion 154 and second coupler portion 156 respectively. First coupler portion 154 and second coupler portion 156 are connected by the plurality of connecting elements 159 and form a vibration isolating portion 151 of vibration isolating coupler 140. Therefore, first connector 144 and second connector 148 may be joined by a stop weld to vibration isolating portion 151 of vibration isolating coupler 140. A welding seam 165 indicates stub welding between box thread connector 146 and second coupler portion 156, and a welding seam 167 indicates stub welding between pin thread connector 150 and first coupler portion 154. Alternatively, box thread connector 146 and pin thread connector 150 can be integral with first coupler portion 154 and second coupler portion 156 respectively, or joined by a different technology, such as by friction welding, laser beam welding, or electron beam welding.

In accordance with an exemplary aspect, first coupler portion 154 includes a first tubular portion 162 with a first annular wall 164 having an external surface 166 and an internal surface 168 that defines a first central bore 170. First annular wall 164 includes a first end 172 and an opposing second end 173. Second coupler portion 156 includes a second tubular portion 171 having a second annular wall 180 including an external surface section 182 and an internal surface section 184 that defines a second central bore 186. In an embodiment, second central bore 186 may provide a passage for drilling fluid passing though drill string 20. Second annular wall 180 includes a first end portion 187 and an opposing second end portion 188. First connector 144 is coupled to first end portion 187 of second coupler portion 156 and second connector 148 is coupled to second end 173 of first coupler portion 154.

Internal surface 168 of first annular wall 164 is spaced from external surface 182 of second annular wall 180. In an embodiment, internal surface 168 is spaced from external surface 182 a distance of about 1 mm. In alternative embodiment, internal surface 168 is spaced from external surface 182 a distance of about of between about 0.1 to 0.9 mm. In yet another exemplary aspect, internal surface 168 is spaced from external surface 182 a distance of about 1 mm to 2 mm. In yet another exemplary aspect, internal surface 168 is spaced from external surface 182 a distance of about 2 mm to 10 mm. In still yet another exemplary aspect, internal surface 168 is spaced from external surface 182 a distance of more than about 10 mm.

In accordance with an exemplary aspect, second coupler portion 156 includes a first plurality of axially spaced openings 190*a* and 190*b* that extend through second annular wall 180 from external surface 182 to internal surface 184 that fluidically connect first central bore 170 and second central bore 186. It should be understood that while shown as being axially spaced, openings 190*a* and 190*b* may be circumferentially spaced or may be both axially and circumferentially spaced. Second coupler portion 156 also includes a second plurality of axially spaced openings 193*a* and 193*b* that is axially and circumferentially offset relative to axially spaced openings 190*a* and 190*b*, a third plurality of axially spaced openings 196*a* and 196*b* that is axially and circumferentially offset relative to openings 190*a*/190*b*, and 193*a*/193*b*, and a fourth plurality of axially spaced openings 198*a* and 198*b* that is axially and circumferentially offset relative to openings 190*a*/190*b*, 193*a*/193*b*, and 196*a*/196*b*. The number and location of axially spaced openings may vary. In an embodiment, first, second, third, and fourth pluralities of axially spaced openings are circumferentially offset 90° relative to one another.

In further accordance with an exemplary embodiment plurality of connecting elements 159 includes a first plurality of connecting elements 207*a* and 207*b*, a second plurality of connecting elements 209*a* and 209*b*, a third plurality of connecting elements 212*a* and 212*b*, and a fourth plurality of connecting elements 214*a* and 214*b*. Connecting elements 207*a* and 207*b* extend from internal surface 168 of first coupler portion 154, through corresponding ones of first plurality of axially spaced openings 190*a* and 190*b*, and join with internal surface 184 of second coupler portion 156.

Connecting elements 209*a* and 209*b* extend from internal surface 168, through corresponding ones of second plurality of axially spaced openings 193*a* and 193*b*, and join with internal surface 184. Connecting elements 212*a* and 212*b* extend from internal surface 168, through corresponding ones of third plurality of axially spaced openings 196*a* and 196*b*, and join with internal surface 184. Connecting elements 214*a* and 214*b* extend from internal surface 168, through corresponding ones of fourth plurality of axially spaced openings 198*a* and 198*b*, and join with internal surface 184.

In an embodiment, first coupler portion 154 is formed from a first material, second coupler portion 156 is formed from a second material, and plurality of connecting elements 159 are formed from a third material. In an exemplary aspect, first, second, third, and fourth materials are substantially identical. In another exemplary aspect, first coupler portion 154, second coupler portion 156 and plurality of connecting elements 159 are integrally formed. That is, first coupler portion 154, second coupler portion 156 and plurality of connecting elements 159 are formed as a single unitary component such as by additive manufacturing. It should however be understood that first, second, and third materials may differ and other manufacturing techniques may be employed. For example, individual parts may be connected by welding, soldering, screwing, clamping or other joining methods. Other methods of manufacture may include investment casting.

Materials used to form the vibration isolating coupler 140 may be Steel, high strength Steel, Titanium, Titanium alloys, Nickel, or Nickel alloys (e.g. Inconel). Materials used may have different material properties, such as modulus of elasticity, modulus of shear, strength, density. In yet another embodiment different parts of the vibration isolating coupler may be formed from different materials to serve elasticity or shear module requirements or corrosion property requirements. Modern additive manufacturing technologies enable combination of different materials within one integral part.

It should also be understood that elastic bending of connecting elements 159 may provide a selected amount of bending flexibility between first coupler portion 154 and second coupler portion 156. Further, it should be understood that downhole components positioned downhole of vibration isolating coupler 140 have a moment of inertia when rotated or oscillated (vibrated). The moment of inertia of the downhole components downhole of vibration isolating coupler 140 taken together with the elastic bending (bending flexibility) provided by connecting elements 159 establishes a first torsional resonance derived from the equation (1.1):

$$f = \frac{1}{2\pi}\sqrt{\frac{k}{I}}$$

where, f=frequency [1/s], I=Moment of Inertia [kgm2], k=Torsion Spring Constant [Nm/rad] of, for example, less than 100 Hz. It should be understood that the moment of inertia may also include contributions of the moment of inertia originating from the vibration isolating coupler.

Thus, vibration isolating coupler 140 isolates (decouples) vibrations between the first coupler portion 154 and second coupler portion 156 with a frequency higher than the first torsional resonance.

In accordance with an exemplary aspect, a load may be introduced into vibration isolating coupler 140 through first connector 144. The load may represent a torsional load, an axial load, and or a bending load. In an embodiment, the load may be imparted to first connector 144 by rotary table 14 and/or drawworks 33. When torsional load (drilling torque or bit torque) is applied between first connector 144 and pin thread connector 150, plurality of connecting elements 159 create a torsional flexible coupling between first coupler portion 154 and second coupler portion 156. Thus, plurality of connecting elements 159 are subjected to bending and allowing an angular movement (angel α (FIG. 7)) of first coupler portion 154 relative to second coupler portion 156.

When applying bending moment between first connector 144 and second connector 148, plurality of connecting elements 159 are subjected to push pull forces, utilizing their entire cross section with evenly distributed stress and hence representing a rather stiff coupling for bending between the first coupler portion 154 and second coupler portion 156. At axial loading the plurality of connecting elements 159 are subjected to bending along their larger moment of inertia, thus bearing comparable low stresses and low deformation.

In further accordance with an exemplary aspect, when torque is applied across the first connector 144 and second connector 148, plurality of connecting elements 159 may deform. Once a predetermined torque level is achieved, one or more of the plurality of connecting elements 159 may get in contact with an opening surface of the corresponding one of the axially spaced openings 190*a*/190*b*, 193*a*/193*b*, 196*a*/196*b*, and 198*a*/198*b*. In such a case, the opening surface creates a torsional end stop such as indicated at 224 in FIG. 7. Torsional end stop 224 limits further deflection and stresses in the plurality of connecting elements 159. Torsional end stop 224 may be utilized to apply high static torque to, for instance, release a stuck in hole component below the isolator. Torsional end stop 224 may take on a variety of forms such as shown in FIG. 8 wherein like reference number represent corresponding parts in the separate views.

Figure 8:
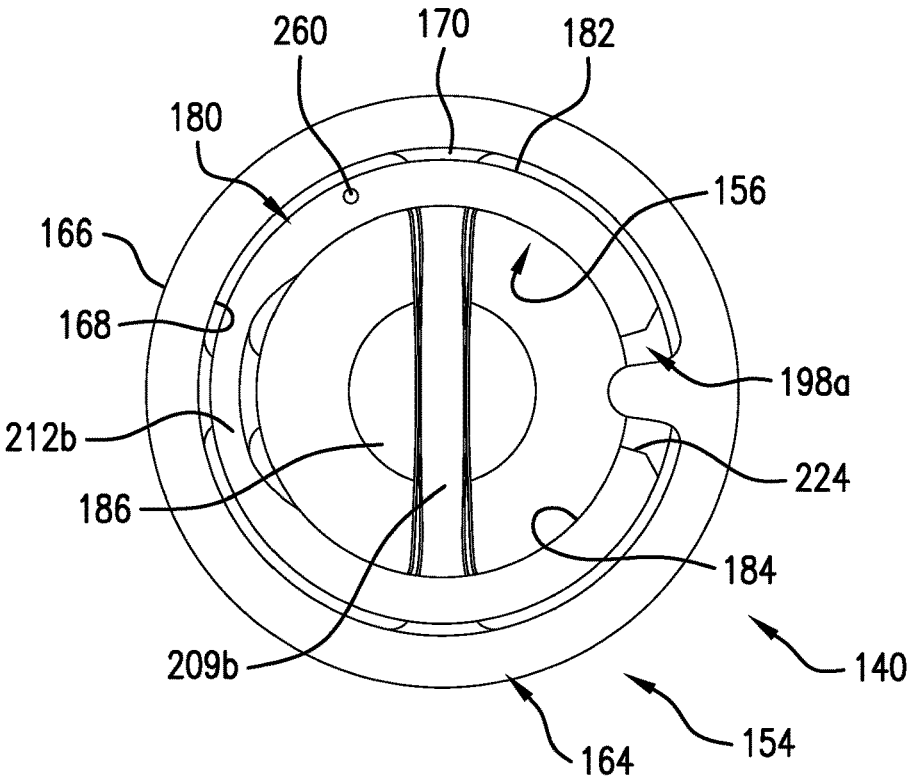
FIG. 8 depicts a cross-sectional end view of the vibration isolating coupler of FIG. 4 in accordance with another aspect of an exemplary embodiment.

In FIG. 8, torsional end stop 224 is separated from the plurality of connecting elements 159. The separation of torsional end stop 224 from the connecting elements 159 prevents potential damage of the plurality of connecting elements 159 when hitting the opening surface (e.g. torsional end stop 224). Torsional end stop 224 may engage (stop) under torsion of vibration isolating coupler 140 before the connecting elements 159 hit the opening surfaces (not separately labeled) of torsional end stop 224. Another reason for separating torsional end stop 224 from connecting elements 159 is the separation of functionalities.

The function of the plurality of connecting elements 159 is to isolate HFTO. When the plurality of connecting elements 159 bend and come into contact with surfaces of, for example, openings 190*a*/190*b*, 193*a*/193*b*, 196*a*/196*b* as a result of torque applied from, for example, surface (drilling torque), no further bending due to HFTO is possible and vibration isolating coupler 140 would lose the isolating functionality. Torsional end stop 224 engages before the plurality of connecting elements hit surfaces of openings 190*a*/190*b*, 193*a*/193*b*, 196*a*/196*b* to maintain the functionality of vibration isolating coupler 140 while limiting its maximum torsion angle caused by high torques.

Figure 7:
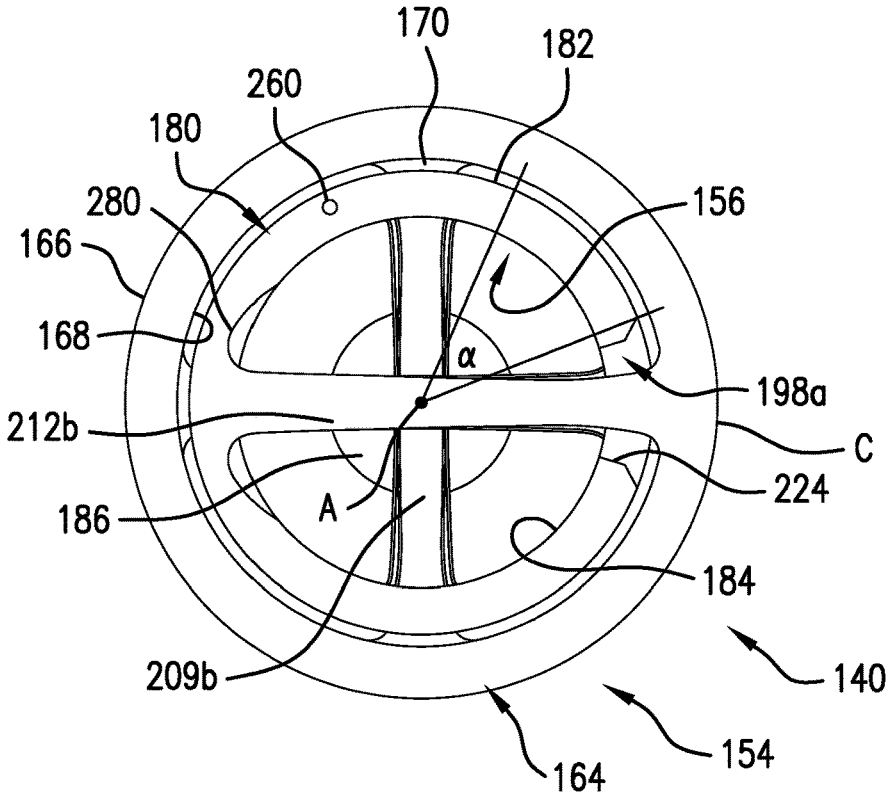
FIG. 7 depicts a cross-sectional end view of the vibration isolating coupler of FIG. 4 taken at the line 5-5 depicting an end stop, in accordance with an aspect of an exemplary embodiment.

Typical torsion of vibration isolating coupler 140 caused by surface torque (drilling torque) may be a torsion angle of about 10°. Typical torsion of vibration isolating coupler 140 caused by HFTO may be a torsion angle of about 15°. The torsion angle refers to an angle α as indicated in FIG. 7. The torsion angle refers to a rotation of first coupler portion 154 relative to second coupler portion 156. In alternative embodiments the torsion angle due to drilling torque may be between about 5° and about 30°. In another embodiment, the torsional angle may be between about 7° and about 20°. In yet another exemplary embodiment, the torsional angle may be between about 8° and about 15°. The torsion angle due to HFTO may also be between about 5° and about 50°; between about 8° and about 30°, and between about 10° and about 20°.

The drilling torque applied by the rotary table is transferred to the drill bit through vibration isolating coupler 140. The plurality of connecting elements 159 bend, but do not hit the surfaces of openings 190*a*/190*b*, 193*a*/193*b*, 196*a*/196*b*. With the drilling process and the cutting forces acting on the disintegrating tool 30, HFTO may be superimposed on the rotation applied by the rotary table at the location of the disintegrating tool 30 and propagates along the BHA. Oscillating bending of the plurality of connecting elements 159 takes place in a direction perpendicular to the longitudinal axis A of the vibration isolating coupler 140. The bending of the plurality of connecting elements 159 decreases along the longitudinal axis A from second connector 148 to first connector 144 for HFTO modes with frequencies at and above the first resonant frequency of the vibration isolating coupler 140.

If vibration isolating coupler 140 perfectly isolates the HFTO, no HFTO is transferred to first connector 144. Isolation of HFTO between second connector 148 and first connector 144 is achieved through torsional softness of vibration isolation portion 140 that allows second coupler portion 148 to rotate relative to first coupler portion 146. In alternative embodiments, the input of HFTO may take place at the first connector 144. This may happen when HFTO is produced closer to the first connector 144 than to the second connector 148, e.g. by a reamer that is located above the vibration isolating coupler 140. Uphole in this disclosure is the end of vibration isolating coupler 140 that is located closer to the surface.

Figure 6:
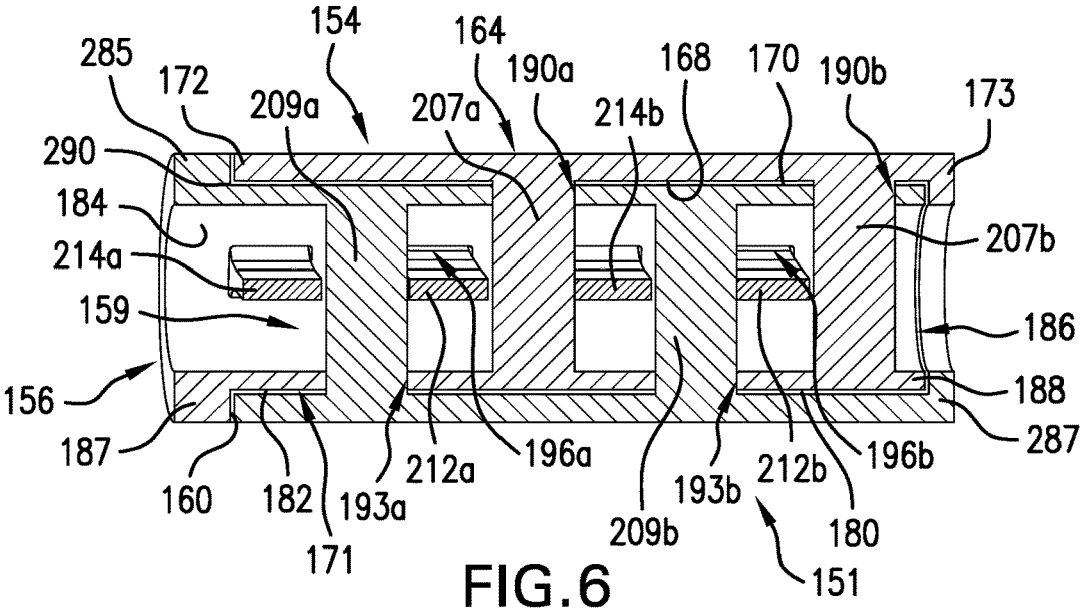
FIG. 6 depicts a plurality of connector elements joining a first coupler portion and a second coupler portion of the vibration isolating coupler, in accordance with an exemplary aspect.

A desired length of the vibration isolating coupler 140 is shorter than 1 m. A suitable thickness of the first and second wall 164/180 may be 10 mm. In embodiments the wall thickness may be between about 5 mm and about 9 mm. In another exemplary aspect, the wall thickness may be between about 11 mm and about 20 mm. In yet another exemplary aspect, the wall thickness may be between about 20 mm and about 50 mm. The wall thickness of first annular wall 164 may differ from the wall thickness of second annular wall 180. The shapes and dimensions may differ among the plurality of the connecting elements 159. It is to be mentioned that the term length in this disclosure refers to an extension along the longitudinal axis A of the vibration isolating coupler and the term width and height refer to an extension along 2 radial directions, wherein the two radial directions are perpendicular to each other. The number of the connecting elements is not limited to eight as shown in FIG. 4-6.

A first portion of the plurality of connecting elements are oriented parallel. A second portion of the plurality of the connecting elements may be oriented perpendicular to the first portion of the plurality of connecting elements 159. In alternative embodiments angles other than 90° between portions of the plurality of connecting elements 159 are contemplated. For example, the first portion of the plurality of connecting elements may be at an angle of between about 1° and about 120° relative to the second portion of the plurality of connecting elements. In another exemplary aspect, the first portion of the plurality of connecting elements may be at an angle of between about 10° and about 90° relative to the second portion of the plurality of connecting elements. In another exemplary aspect, the first portion of the plurality of connecting elements may be at an angle of between about 10° and about 45° relative to the second portion of the plurality of connecting elements. In still a further exemplary aspect, the first portion of the plurality of connecting elements may be at an angle of between about 45° and about 90° relative to the second portion of the plurality of connecting elements.

In an exemplary aspect, it should be understood that only two connecting elements may be used. In another embodiment, between 3 and 50 connecting elements may be used. In yet another embodiment a significantly larger number of connecting elements may be used. For example, vibration isolation coupler 140 could be formed with more than 1000 connecting elements. In such a case the connecting elements 159 would be oriented between internal surface 168 of first coupler portion and internal surface 184 of second coupler portion forming a spoke-like pattern. In case of a spoke-like pattern configuration, angle between adjacent connecting element may be 5° or less.

At this point, it should be understood that the vibration isolating coupler isolates vibrations passing from, for example, the disintegrating device uphole. Disintegrating device 30 is located below the vibration isolating coupler 140 and is closer to second connector 148 than to first connector 144. Vibrations may be decoupled (isolated) by the plurality of connecting elements 159 such that amplitudes above vibration isolating coupler 140 may be significantly smaller than below vibration isolating coupler 140. In the exemplary embodiment, torsional vibrations with a frequency higher than the first natural frequency of the simplified substituted mechanical system, represented by the moment of inertia of BHA segments 250 (including the disintegrating device) below the vibration isolating coupler 140 and the torsional spring constant (proportional to torsional rigidity) of the plurality of connecting elements 159, will be cut off. The BHA segment 250 may comprise a drill bit 30 and a steering unit 29. The first natural frequency of the simplified substituted mechanical system can be calculated by the formula as given in equation 1.1.

Comparable to a mechanical low pass filter, the vibration isolation of the vibration isolating coupler 140 results from the significantly smaller (first) natural frequency (e.g. 30 Hz), the cut off frequency, compared to the critical excitation frequencies of HFTO. A typical value for a cut off frequency of the described mechanical system might be at 10 Hz, 50 Hz, 100 Hz or 200 Hz, selected depending on the expected undesirable HFTO frequency excited within the BHA. The cut off frequency might be adjusted by the torsional rigidity of the connecting elements (or torsion spring constant of the vibration isolating coupler) or the moment of inertia of the components placed below the vibration isolating coupler 140 e.g. by adding or removing BHA segments below the coupler, such as drill pipe, heavy weight drill pipe, or flex pipe.

In addition to reducing vibrations, the vibration isolating coupler may serve as a conduit for drilling fluids. Typically, the pressure of the drilling fluid in the center of the tool is higher than in the annulus. The center of the tool fluid passage is connected to the inner bore of the drill string and the inner bore of the BHA, while the annulus is the return of the drilling fluids, towards the surface. The bore pressure is at least subjected to pressure increase by the pressure losses caused by the nozzles in the disintegration device and/or the dynamic pressure drop of the flowing fluid through and around the downhole tools (BHA section) below the isolation coupler. As shown in FIGS. 5-6, there might be (small)

flow passages at seal 160 between the bore fluid and the annulus. By providing and sizing a gaps at seal 160 appropriately (e.g. 0.1 mm), the fluid leakage through these gaps can have a controlled and tolerable flow. Allowing controlled leakage of fluid flow eliminates the need for expensive and delicate seals that seal under rotation and/or oscillation. Other options, not explicitly detailed here, can include labyrinth seals, elastomer seals, gap seals, magnetic seals, bellows seals or other sealing elements (collectively numbered 160 in FIG. 5 and FIG. 6).

Vibration isolating coupler 140 may also accommodate the passage of control signals by providing a passage for conductors such as shown at 260 in FIG. 4. Such passage for conductors 260 allows feeding an electrical or optical conductor, wire, or cable through the vibration isolating coupler 140 for transmission of electrical power and/or communication (such as a Power Line bus) through the vibration isolating coupler 140 from the downhole component above to the downhole component below and vice versa. Electrical conductor may, for example, extend through the first connector 144, the second annular wall 180, one or more of the plurality of connecting elements 159, the first annular wall 164 and transition into second connector 148. The passage for conductors 260 may be terminated in a modular electrical connector, which in turn may take the form of an electrical contact such as a contact ring placed in an annular recess 270, a sliding contact, an inductive connection, or a resonant electromagnetic coupling device positioned at connectors 150 and 146.

It should be understood that other connector types are also possible. Further, it should be understood that conductors 200 may terminate in a central connector (not shown) located in a central bore (not separately labeled) of first connector 144 and second connector 148. The central bore, also referred to inner bore, is fluidly connected to the inner bore of the BHA and the drill string and provides passage for the drilling fluid.

The bending of the plurality of connecting elements 159 causes mechanical stresses in the portions of the vibration isolating coupler 140. These stresses are localized predominantly at locations with sharp edges, e.g. in the areas where a connecting element is attached to the internal surface 168 of the first annular wall 164 and to the internal surface 184 of the second annular wall 180. To reduce mechanical stresses in these areas transitions with a defined radius are formed during the manufacturing process, as shown, for example, at exemplary indicated generally at 280 in FIG. 7.

In alternative embodiments, instead of a single radius a three-center-curve may be formed. A similar strategy may be employed for a first load transfer ring 285 located at first end portion 187 of second annular wall 180 and/or a second load transfer ring 287 located at a second end portion 173 of first annular wall 164. A radius corner 290 may be formed at the transition between the second annular wall 180 and the first load transfer ring 285. A corresponding radius corner may be formed at the transition between first annular wall 164 and second load transfer ring 287. The load transfer rings 285/287 transfer loads from and to first connector 144 and from and to second connector 148, such as axial load, bending load, torsional load. In alternative embodiments instead of a single radius a three-center-curve may be formed. Finite element simulation (FE simulation, FE modeling) may be used to model vibration isolating couplers with different material properties and dimension of different portions of the vibration isolating coupler 140 (e.g. number and dimension of the plurality, connecting elements 159, length of the vibration isolating portion 151) to optimize and fine-tune the ratio of bending stiffness to torsional stiffness (BST/TST) to be as big as possible, e.g. a ratio of bigger than 15.

Set forth below are some embodiments of the foregoing disclosure:

Embodiment 1

A vibration isolating coupler for isolating torsional vibration in a drill string comprising: a first coupler portion including a first annular wall having an external surface and an internal surface defining a first central bore portion; a second coupler portion disposed within the first central bore portion, the second coupler portion including a second annular wall having an external surface section and an internal surface section defining a second central bore portion; and a plurality of connecting elements extending from the internal surface of the first annular wall through the second annular wall across the second central bore portion and connecting with the internal surface of the second annular wall.

Embodiment 2

The vibration isolating coupler according to any prior embodiment, wherein the second coupler portion includes a plurality of axially spaced openings extending from the external surface section of second annular wall through the second annular wall to the internal surface section of second annular wall.

Embodiment 3

The vibration isolating coupler according to any prior embodiment, wherein the plurality of axially spaced openings include a first plurality of axially spaced openings, a second plurality of axially spaced openings circumferentially offset relative to the first plurality of axially spaced openings, a third plurality of axially spaced openings circumferentially offset from the first plurality of axially spaced openings and the second plurality of axially spaced openings.

Embodiment 4

The vibration isolating coupler according to any prior embodiment, further comprising: a conductor extending through at least one of the plurality of connecting elements.

Embodiment 5

The vibration isolating coupler according to any prior embodiment, wherein the external surface of the second annular wall is spaced from the internal surface of the first annular wall.

Embodiment 6

The vibration isolating coupler according to any prior embodiment, further comprising: a seal arranged between the first coupler portion and the second coupler portion.

Embodiment 7

The vibration isolating coupler according to any prior embodiment, wherein the first coupler portion includes a first tubular portion, and the second coupler portion includes a second tubular portion, the first tubular portion, the second tubular portion and the plurality of connecting elements are formed from the same material.

Embodiment 8

The vibration isolating coupler according to any prior embodiment, wherein the first coupler portion includes a first tubular portion and the second coupler portion includes a second tubular portion, the first tubular portion and the second tubular portion are formed from a first material, and the plurality of connecting elements are formed from a second material that is different to the first material.

Embodiment 9

The vibration isolating coupler according to any prior embodiment, wherein the plurality of connecting elements are integrally formed with the first coupler portion and the second coupler portion.

Embodiment 10

The vibration isolating coupler according to any prior embodiment, wherein the second coupler portion is concentric with the first coupler portion.

Embodiment 11

The vibration isolating coupler according to any prior embodiment, wherein the first annular wall includes a first end and a second end, and the second annular wall includes a first end portion and a second end portion, the first end portion of second annular wall supporting a first connector and the second end of first annular wall supporting a second connector.

Embodiment 12

The vibration isolating coupler according to any prior embodiment, wherein the first connector comprises a box thread connector and the second connector comprises a pin connector.

Embodiment 13

The vibration isolating coupler according to any prior embodiment, further comprising a first connector and a second connector, wherein the first connector is connected to the second annular wall by welding and the second connector is connected to the first annular wall by welding.

Embodiment 14

The vibration isolating coupler according to any prior embodiment, wherein the vibration isolating coupler includes a torsion spring constant, the torsion spring constant defining a torsional resonance frequency of less than 100 Hz thereby isolating vibrations between the first and the second coupler portion with a frequency higher than about the torsional resonance frequency.

Embodiment 15

The vibration isolating coupler according to any prior embodiment, wherein the vibration isolating coupler isolates torsional vibration by elastic bending of the plurality of connecting elements.

Embodiment 16

A method of isolating torsional vibrations from one portion of a drill string connected to another portion of the drill string through a vibration isolating coupler having a first coupler portion connected to a second coupler portion through a plurality of connecting elements, the method comprising: introducing the torsional vibrations into the first coupler portion; transferring the torsional vibration into the plurality of connector elements extending from an internal surface section of the second coupler portion, through an annular wall of the second coupler portion to an internal surface of the first coupler portion; and isolating the torsional vibrations passing from the first coupler portion to the second coupler portion by elastic bending of the plurality of connecting elements.

Embodiment 17

The method according to any prior embodiment, wherein isolating torsional vibrations includes elastically bending the plurality of connecting elements in a direction perpendicular to a longitudinal axis of the vibration isolating coupler.

Embodiment 18

The method according to any prior embodiment, further comprising: limiting torsion angle of the second connector portion relative to the first connector portion through at least one torsional end stop.

Embodiment 19

The method according to any prior embodiment, further comprising: passing drilling fluid through the vibration isolating coupler.

Embodiment 20

The method according to any prior embodiment, further comprising: selecting torsional stiffness of the vibration isolating coupler to having a torsional resonance frequency of the vibration isolating coupler less than 100 Hz; and selecting the moment of inertia of a drill string section positioned below the vibration isolating coupler to a moment of inertia having the torsional resonance frequency of the vibration isolating coupler; and, isolating torsional vibrations between the first and the second coupler portion having a frequency higher than about the torsional resonance frequency.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A vibration isolating coupler for isolating torsional vibration in a drill string comprising:

a first coupler portion including a first annular wall having an external surface and an internal surface defining a first central bore portion;

a second coupler portion disposed within the first central bore portion, the second coupler portion including a second annular wall having an external surface section and an internal surface section defining a second central bore portion; and a plurality of connecting elements extending from the internal surface of the first annular wall through the second annular wall across the second central bore portion and connecting with the internal surface section of the second annular wall, wherein the vibration isolating coupler isolates torsional vibration by elastic bending of the plurality of connecting elements.

2. The vibration isolating coupler according to claim 1, wherein the second coupler portion includes a plurality of axially spaced openings extending from the external surface section of second annular wall through the second annular wall to the internal surface section of second annular wall and the plurality of axially spaced openings include a first plurality of axially spaced openings, a second plurality of axially spaced openings circumferentially offset relative to the first plurality of axially spaced openings, a third plurality of axially spaced openings circumferentially offset from the first plurality of axially spaced openings and the second plurality of axially spaced openings.

3. The vibration isolating coupler according to claim 1, further comprising: a conductor extending through at least one of the plurality of connecting elements.

4. The vibration isolating coupler according to claim 1, further comprising: a seal arranged between the first coupler portion and the second coupler portion.

5. The vibration isolating coupler according to claim 1, wherein the first coupler portion includes a first tubular portion, and the second coupler portion includes a second tubular portion, the first tubular portion, the second tubular portion and the plurality of connecting elements are formed from the same material.

6. The vibration isolating coupler according to claim 1, wherein the first coupler portion includes a first tubular portion and the second coupler portion includes a second tubular portion, the first tubular portion and the second tubular portion are formed from a first material, and the plurality of connecting elements are formed from a second material that is different to the first material.

7. The vibration isolating coupler according to claim 1, wherein the plurality of connecting elements are integrally formed with the first coupler portion and the second coupler portion.

8. The vibration isolating coupler according to claim 1, wherein the second coupler portion is concentric with the first coupler portion.

9. The vibration isolating coupler according to claim 1, wherein the first annular wall includes a first end and a second end, and the second annular wall includes a first end portion and a second end portion, the first end portion of the second annular wall supporting a first connector and the second end of the first annular wall supporting a second connector, wherein the first connector comprises one of a first box thread connector and a first pin thread connector and the second connector comprises one of a second box thread connector and a second pin thread connector.

10. The vibration isolating coupler according to claim 1, wherein the plurality of connecting elements are connected to at least one of the first coupler portion and the second coupler portion by one of welding, soldering, screwing, and clamping.

11. A method of isolating torsional vibrations from one portion of a drill string connected to another portion of the drill string through a vibration isolating coupler having a first coupler portion connected to a second coupler portion through a plurality of connecting elements, the method comprising:

introducing the torsional vibrations into the first coupler portion;

transferring the torsional vibrations into the plurality of connecting elements extending from an internal surface section of the second coupler portion, through an annular wall of the second coupler portion to an internal surface of the first coupler portion; and isolating the torsional vibrations by elastic bending of the plurality of connecting elements.

12. The method of claim 11, wherein isolating torsional vibrations includes elastically bending the plurality of connecting elements in a direction perpendicular to a longitudinal axis of the vibration isolating coupler.

13. The method of claim 11, further comprising: limiting torsion angle of the second coupler portion relative to the first coupler portion through at least one torsional end stop.

14. The method of claim 11, further comprising: passing drilling fluid through the vibration isolating coupler.

15. A vibration isolating coupler for isolating torsional vibration in a drill string comprising:

a first coupler portion including a first annular wall having an external surface and an internal surface defining a first central bore portion;

a second coupler portion disposed within the first central bore portion, the second coupler portion including a second annular wall having an external surface section and an internal surface section defining a second central bore portion; and a plurality of connecting elements extending from the internal surface of the first annular wall through the second annular wall across the second central bore portion and connecting with the internal surface section of the second annular wall, wherein the second coupler portion includes a plurality of axially spaced openings extending from the external surface section of the second annular wall through the second annular wall to the internal surface section of the second annular wall.

16. The vibration isolating coupler according to claim 15, wherein the vibration isolating coupler isolates torsional vibration by deformation of the plurality of connecting elements.

17. The vibration isolating coupler according to claim 15, further comprising: a conductor extending through at least one of the plurality of connecting elements.

18. The vibration isolating coupler according to claim 15, further comprising: a seal arranged between the first coupler portion and the second coupler portion.

19. The vibration isolating coupler according to claim 15, wherein the first coupler portion includes a first tubular portion and the second coupler portion includes a second tubular portion, the first tubular portion, the second tubular portion, and the plurality of connecting elements being formed from the same material.

20. The vibration isolating coupler according to claim 15, wherein the plurality of connecting elements are integrally formed with the first coupler portion and the second coupler portion.

21. The vibration isolating coupler according to claim 15 wherein the first annular wall includes a first end and a second end, and the second annular wall includes a first end portion and a second end portion, the first end portion of the second annular wall supporting a first connector and the second end of the first annular wall supporting a second connector, wherein the first connector comprises one of a first box thread connector and a first pin thread connector and the second connector comprises one of a second box thread connector and a second pin thread connector.

22. A vibration isolating coupler for isolating torsional vibration in a drill string comprising:

a first coupler portion including a first annular wall having an external surface and an internal surface defining a first central bore portion;

a second coupler portion disposed within the first central bore portion, the second coupler portion including a second annular wall having an external surface section and an internal surface section defining a second central bore portion; and a plurality of connecting elements extending from the internal surface of the first annular wall through the second annular wall across the second central bore portion and connecting with the internal surface section of the second annular wall, wherein the vibration isolating coupler includes a torsion spring constant, the torsion spring constant defining a torsional resonance frequency of less than 100 Hz thereby isolating vibrations between the first and the second coupler portion with a frequency higher than about the torsional resonance frequency.

23. The vibration isolating coupler according to claim 22, wherein the vibration isolating coupler isolates vibration by deformation of the plurality of connecting elements.

24. The vibration isolating coupler according to claim 22, wherein the second coupler portion includes a plurality of circumferentially spaced openings extending from the external surface section of the second annular wall through the second annular wall to the internal surface section of the second annular wall.

25. The vibration isolating coupler according to claim 22, further comprising: a conductor extending through at least one of the plurality of connecting elements.

26. The vibration isolating coupler according to claim 22, further comprising: a seal arranged between the first coupler portion and the second coupler portion.

27. The vibration isolating coupler according to claim 22, wherein the first coupler portion includes a first tubular portion, and the second coupler portion includes a second tubular portion, the first tubular portion, the second tubular portion and the plurality of connecting elements are formed from the same material.

28. The vibration isolating coupler according to claim 22, wherein the plurality of connecting elements are integrally formed with the first coupler portion and the second coupler portion.

29. The vibration isolating coupler according to claim 22, wherein the first annular wall includes a first end and a second end, and the second annular wall includes a first end portion and a second end portion, the first end portion of the second annular wall supporting a first connector and the second end of the first annular wall supporting a second connector, wherein the first connector comprises one of a first box thread connector and a first pin thread connector and the second connector comprises one of a second box thread connector and a second pin thread connector.

30. A method of isolating torsional vibrations from one portion of a drill string connected to another portion of the drill string through a vibration isolating coupler having a first coupler portion connected to a second coupler portion through a plurality of connecting elements, the method comprising:

selecting a torsional stiffness of the vibration isolating coupler to having a torsional resonance frequency of the vibration isolating coupler less than 100 Hz; and selecting the moment of inertia of a drill string section positioned one of above or below the vibration isolating coupler to a moment of inertia having the torsional resonance frequency of the vibration isolating coupler;

introducing the torsional vibrations into one of the first coupler portion and the second coupler portion;

transferring the torsional vibrations into the plurality of connecting elements extending from an internal surface section of the second coupler portion, through an annular wall of the second coupler portion to an internal surface of the first coupler portion; and isolating torsional vibrations between the first and the second coupler portion having a frequency higher than about the torsional resonance frequency.

* * * * *